US005407080A

United States Patent [19]

Welch et al.

[11] Patent Number: 5,407,080

[45] Date of Patent: Apr. 18, 1995

[54] APATITE FLOTATION REAGENT

[75] Inventors: William E. Welch, Chicago; John C. Miller, Hawthorne Woods, both of Ill.

[73] Assignee: Tomah Products, Inc., Milton, Wis.

[21] Appl. No.: 70,599

[22] Filed: Jun. 1, 1993

[51] Int. Cl.[6] ..... B03D 1/014; B03D 1/08; B03D 1/02

[52] U.S. Cl. ..... 209/166; 209/167; 252/61

[58] Field of Search ..... 252/61; 209/166, 167, 209/902

[56] References Cited

U.S. PATENT DOCUMENTS

| | | |
|---|---|---|
| 4,358,368 | 11/1982 | Hellsten et al. . |
| 4,505,990 | 3/1985 | Dasgupta . |
| 4,514,290 | 4/1985 | Swiatkowski . |
| 4,612,112 | 9/1986 | Swiatkowski . |
| 4,732,667 | 3/1988 | Hellsten et al. . |
| 4,795,578 | 1/1989 | Hellsten et al. . |
| 4,828,687 | 5/1989 | Hellsten et al. . |
| 4,931,195 | 6/1990 | Cao . |
| 5,230,818 | 7/1993 | James ..... 252/62.55 |

FOREIGN PATENT DOCUMENTS

| | | |
|---|---|---|
| 895594 | 3/1972 | Canada . |
| 1451194 | 9/1976 | United Kingdom . |

OTHER PUBLICATIONS

Taking the Flaw Out of Ore.

*Primary Examiner*—Thomas M. Lithgow
*Attorney, Agent, or Firm*—Jansson & Shupe, Ltd.

[57] ABSTRACT

This invention relates to apatite flotation reagents which can be used simultaneously with silica collectors in a coflotation process without problems of incompatibility between the apatite flotation reagent and the silica collectors. The apatite flotation reagent includes soya lecithin. The soya lecithin can be used as an apatite collector by itself or can be blended with a phosphate ester, preferably an ethylene oxide modified alcohol based phosphate ester. In an additional embodiment, the apatite flotation reagent can be solely comprised of a phosphate ester, preferably an ethylene oxide modified alcohol based phosphate ester.

18 Claims, No Drawings

APATITE FLOTATION REAGENT

FIELD OF THE INVENTION

This invention is related generally to ore separation processes and, more particularly, to ore flotation processes which utilizes collector agents and the like.

BACKGROUND OF THE INVENTION

In the mining industry, depletion of high-grade ore over the years has invariably resulted in development of methods to utilize ore containing impurities and lower concentrations of the desired mineral. Low-grade impure ore is concentrated and purified to meet commercial standards, through various processes collectively referred to in the industry as "beneficiation". An overriding concern, of course, is efficiency. Any such method must be cost effective and competitive with the recovery of naturally high-grade ores.

The mining and purification of iron ore exemplifies this wide-spread phenomenon. Nowadays, it is common for lower grade ore to contain only about 35% iron. Typically, in one common beneficiation process, hematite, magnetite, goethitite, or martite-type ore is finely ground to liberate undesirable mineral impurities referred to as "gangue". Gangue, as found in most iron ore deposits, is a siliceous material such as quartz, clay, etc. and will hereinafter be referred to as silica, the presence of which adversely affects steel quality and the amount of slag bi-product generated in its manufacture.

After being ground, the ore or a concentrate thereof is then mixed with water to form a pulp, which is transferred to a large flotation cell. Air is introduced into and passed through the pulp. A frothing agent, usually a low molecular weight alcohol may be used. The froth formed is skimmed off or allowed to overflow. Undesirable silica floats away with the froth, leaving a more pure ore concentration for further processing into pellets or other suitable material.

In carrying out the flotation step, a collector agent capable of silica chelation is added to the pulp. Typically, ether or fatty amines and diamines are used to float or remove silica from iron ore. Common ether amines used include octyl/decyloxypropylamine available from Exxon Chemical Company under the designation "PA-1214". An additional ether amine which is commonly used to float silica is an ether amine partially neutralized with acetic acid. This ether amine is N-isotridecyloxypropyl-1,3-diaminopropane, commonly available from Exxon Chemical Company under the designation "DA-17". Such ether amines, called collectors, are surface active substances in which the main components are cationic.

In addition to silica, some iron ore bodies also contain low levels of phosphorous containing minerals such as various calcium phosphates, etc. which unless removed along with the silica during the flotation process becomes concentrated along with the iron in the ore. Apatite is a general term used to describe these phosphorous containing minerals. Such phosphorous containing compounds are undesirable in iron ore pellets. Phosphorous in steel makes it difficult to form into shapes, therefore, to meet quality standards it is necessary to reduce the phosphorous level in iron ore pellets. A commonly acceptable level is approximately 0.030–0.035% phosphate.

There have been numerous attempts to remove the phosphorous containing compounds at the iron ore mines via flotation. It is advantageous to remove apatite at the iron mines prior to forming the iron ore pellets to provide more pure pellets ready for further processing, rather than requiring further purification. Unfortunately, attempts to remove apatite at the mines has not been easily accomplished. Typically, apatite collectors are anionic in nature and therefore not compatible with cationic silica collectors. These incompatibility problems affect the apatite collecting ability and/or the silica collecting ability. In order to remove both the silica and apatite from the ore, a two-stage flotation is generally required. Several disadvantages are found in using a two-stage flotation. Mainly these disadvantages revolve around higher capital costs and potential greater iron loss due to the additional processing, separate water processing streams to eliminate cross contamination of the anionic and cationic flotation steps and duplicate flotation equipment. Additionally, added time and increased labor add to overall cost.

In summary, a considerable number of drawbacks and problems exist in the art relating to the removal of silica and phosphorous in ore flotation processes. There is a need for improved apatite collectors that are compatible with common silica collectors and can be used in a coflotation process.

OBJECTS OF THE INVENTION

It is an object of this invention to provide an improved ore flotation reagent overcoming some of the problems and shortcomings of those of the prior art.

Another object of this invention is to provide an improved ore flotation reagent for the beneficiation of mineral ores, particularly iron ores.

Another object of this invention is to provide an improved ore flotation reagent to remove phosphorous containing compounds.

It is a further object of this invention to provide an ore flotation reagent which can be used in conjunction with a silica collector in a single coflotation process.

These and other important objects will be apparent from the following descriptions of this invention which follow.

SUMMARY OF THE INVENTION

This invention includes an improved apatite flotation reagent or collector and a method for use in ore separation processes, in particular, froth flotation processes. It overcomes certain well-known problems and deficiencies of the prior art, including those outlined above. An important aspect of this invention is the ability to remove silica impurities as well as phosphorous impurities in one coflotation process without the problems of incompatibility between the cationic silica collectors and the apatite collectors. The improved apatite flotation reagent includes lecithin from animal or vegetable sources having the general formula:

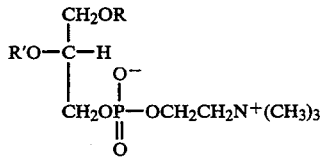

The improved apatite flotation reagent can comprise solely lecithin or can be a blend of the lecithin with a phosphate ester, preferably an ethylene oxide modified alcohol based phosphate ester. Such a blend results in a more productive reagent for the removal of phosphorous compounds in a coflotation process with ether amine silica collectors. Alternatively, the improved apatite collector can be solely comprised of a phosphate ester, in particular, an ethylene oxide modified alcohol based phosphate ester.

Thus the improved apatite flotation reagent of the present invention comprises 0-100 weight percent lecithin and 100-0 weight percent phosphate ester, with a blend of 50 weight percent lecithin and 50 weight percent phosphate ester being highly preferred.

DETAILED DESCRIPTION OF THE PREFERRED EMBODIMENTS

The present invention is directed to an improved apatite flotation reagent or collector for use in the mining industry. In one embodiment the improved apatite flotation reagent is lecithin. Lecithin includes various phosphatides. The main phosphoglycerides that are present in commercial lecithins have the general structural formula:

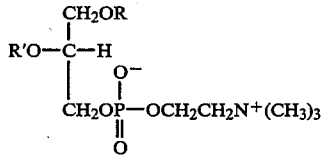

wherein R and R′ are longer chain fatty groups containing approximately 8–20 carbon atoms.

Lecithin can be derived from animal or vegetable sources. Some commonly used vegetable oil sources include soybean, corn, rapeseed, peanut, sunflower and safflower oils. The phosphatides that are present in lecithins from these various sources are similar except that their proportions vary and, thus, their properties vary. With respect to minor constituents, there are differences between the commercial lecithins that are derived from these different sources. All commercial lecithin products are not the same, but can vary according to their source, component phosphatides and other constituents, and with the processing to which they are subjected. Resulting differences in properties have distinct biological significance. In animal and vegetable lecithins, both saturated and unsaturated fatty acids are present but their proportions vary over a wide range in relation to the source and in particular to the composition of the triglyceride with which the lecithin is associated in nature.

Commercial lecithin is derived almost entirely from soybeans because of the relatively large amounts of lecithin in crude soybean oil, usually 2.5 to 3.25% in terms of commercial lecithin, and because of the enormous quantities of soybeans grown and processed. Crude soya lecithin consists of roughly of 64% mixed phosphatides and 36% crude soybean oil.

Commercial lecithin derived from soybeans, soya lecithin, and commercial vegetable lecithin from other sources, in contrast to animal lecithins, are characterized by a relatively high percentage of free and bound carbohydrates that essentially are plant sugars, i.e., dextrose, raffinose, galactose, and stachyose. Cholesterol is absent from soya lecithin but substantial amounts of phytosterols and sterol glycosides are present.

Commercial soya lecithin contains phosphates that contain both nitrogen and phosphorous. These phosphates will have selectivity for phosphorous containing compounds and therefore will produce a good selective apatite collector. In addition, these phosphorous and nitrogen containing phosphates are compatible with cationic silica collectors, notably fatty (ether) amines and diamines which are commonly used.

Commercial lecithin is a wetting and emulsifying agent inasmuch as its constituents, i.e., fatty acid-containing phosphatides, are amphipathic in chemical structure, having strongly lipophilic, fat-forming acid nuclei at one end of the molecule and a strongly hydrophilic amino or phosphoric acid nucleolus at the opposite end. Lecithin is one of the very few natural and edible interface-active agents of this type that is soluble or dispersible in oil. The main components of soya lecithin, phosphatidylcholine and phosphatidylethanolamine are cationic and anionic at the same time, i.e., they are zwitterions. Thus, lecithin does not exhibit compatibility problems with cationic silica collectors that other prior art apatite collectors have exhibited.

Such an apatite collector is compatible with cationic silica collectors thereby enabling a flotation process wherein both silica and apatite can be removed from the ore simultaneously in a coflotation process.

Soya lecithin is available in granular form (oil free) or in liquid form. Soya lecithin is commonly available from ADM Ross & Rowe Company of Decatur, Ill. under various trademarks including "YELKIN SS", "YELKIN" TS, "YELKIN" TM, "STABLEC", IDC50, and "STABLEC" EDS 90. Each of these various soya lecithins contain various amounts of soybean oil, and exhibit various other characteristics such as liquidity and water dispersability. It has been noted that the soya lecithins containing about 35% soybean oil perform better than those containing greater amounts of soybean oil (about 50% soybean oil). However, granular (oil free) lecithin, while showing improved apatite collection, did not work as well as crude soya lecithin (oil containing).

In an additional embodiment, a phosphate ester can be blended with soya lecithin to provide an improved apatite flotation reagent which can be used simultaneously with common silica collectors. The addition of the phosphate ester improves weight recovery and iron recovery.

The phosphate ester is preferably an ethylene oxide modified alcohol based phosphate ester, wherein the alkyl group of the phosphate ester includes six to twenty-six carbon atoms. Additionally, the alkyl group is preferably highly branched. Preferred phosphate esters include isododecyl phosphate esters and isooctyl phosphate esters. Highly preferred phosphate esters are ethylene oxide modified alcohol based phosphate esters such as Bis-[tri-(2-hydroxyethyl)-] isododecyl phosphate commonly available from Exxon Chemical Company under the designation "Phosester 230" and Bis-[Nona-(2-hydroxyethyl)-] isododecyl phosphate commonly available from Exxon Chemical Company under the designation "Phosester 290". It should be noted that other ethylene oxide modified alcohol based phosphate esters known to one of ordinary skill in the art can also be successfully utilized.

The phosphate ester is preferably blended with the soya lecithin, prior to addition to the coflotation process; however, it is possible to add the lecithin and the phosphate ester to the coflotation separately. In a blend of lecithin and phosphate ester the soya lecithin can comprise approximately 0.5–99.5 weight percent of the apatite collector and the phosphate ester can comprise approximately 99.5–0.5 weight percent of the apatite collector. A preferred blend includes approximately 50.0–85.0 weight percent lecithin and 15.0–50.0 weight percent phosphate ester, with the most highly preferred blend being 50.0 weight percent lecithin and 50.0 weight percent phosphate ester.

Additionally, the phosphate ester, preferably an ethylene oxide modified alcohol based phosphate ester as discussed above, can be used by itself as an improved apatite collector. An apatite collector consisting solely of phosphate ester can also be used simultaneously with a silica collector in a coflotation process.

EXAMPLES

Example 1

This test was done in the laboratory using ore samples initially containing a range 0.039–0.044% phosphorous. The test was run using crude soya lecithin solely as an apatite collector, "Phosester 230" as an apatite collector, a blend of 50 weight percent crude soya lecithin and 50 weight percent "Phosester 230" and finally, "Phosester 290" as the sole apatite collector. The ether amine silica collector was fed at a rate of 0.20 Lb/Lt (Longton). The results are shown below.

| | | Combined Flotation Concentrate | | | | | |
|---|---|---|---|---|---|---|---|
| Reagent Type | Reagent Rate Lb./LT | % Fe | % $SiO_2$ | % Phos | % Wgt Rec. | % Fe Rec. | % Phos Rec. |
| Baseline (no phos reducer) | — | 65.9 | 4.47 | 0.042 | 33.8 | 62.0 | 34.8 |
| Crude Soya Lecithin | 0.30 | 66.4 | 3.86 | 0.032 | 31.5 | 57.9 | 23.6 |
| Phosester 230 | 0.30 | 64.5 | 7.07 | 0.029 | 36.3 | 64.5 | 24.8 |
| 50/50 Blend | 0.30 | 65.1 | 5.46 | 0.032 | 36.7 | 66.2 | 26.5 |
| Phosester 290 | 0.30 | 65.8 | 5.00 | 0.029 | 35.0 | 67.2 | 25.6 |

As can be seen from the above data, each of the various apatite collectors improved the phosphorous content of the resulting product, however, the blend of "Phosestor 230" and the crude soya lecithin achieved desirable cost effective overall results with a reduction of the phosphorous content of the ore from 0.042 to 0.032 while maintaining an acceptable silica level.

Specifically, each of the various apatite collectors improved the phosphorous content of the concentrate. Crude soya lecithin not only improved the phosphorous content, but also improved (lowered) the silica content. However, crude soya lecithin had lower weight and iron recovery. "Phosester 230" produced a low phosphorous concentrate and good weight and iron recovery. However, "Phosester 230" yielded high silica content. To improve overall results, the blend was tested. The blend of crude soya lecithin and "Phosester 230" gave good weight and iron recovery, low phosphorous content as well as good silica content. "Phosester 290" gave good silica, phosphorous, weight and iron recovery results. However, synthetic phosphate esters are more costly than naturally derived products such as lecithin. Due to these cost/benefit concerns the blend of crude soya lecithin and "Phosester 230" was tested in the plant. The results are found in Example 2.

Example 2

This test was done in an actual ore flotation operation using bulk quantities of ore in a continuous process over a period of several days. All of the testing was done using an apatite collector comprising a blend of 50 weight percent "Phosester 230" and 50 weight percent crude soya lecithin. The data designated as "Control" data shows the content of the ore when no apatite collector is used.

| | Flot. Feed | | Rougher Conc. | | | | | |
|---|---|---|---|---|---|---|---|---|
| Line | % Fe | % P | % Fe | % SiO2 | % P | % Wt. | % Fe Rec. | % P Rec. |
| Test | 42.9 | 0.030 | 60.7 | 3.90 | 0.036 | 57.4 | 81.2 | 68.9 |
| Control | 42.8 | 0.028 | 59.7 | 4.46 | 0.042 | 60.9 | 84.9 | 91.3 |
| Test | 43.5 | 0.025 | 61.3 | 4.08 | 0.031 | 57.3 | 80.8 | 71.1 |
| Control | 43.3 | 0.023 | 60.7 | 4.40 | 0.034 | 60.2 | 84.4 | 89.0 |
| Test | 44.1 | 0.028 | 61.5 | 4.69 | 0.032 | 62.3 | 86.9 | 71.2 |
| Control | 44.4 | 0.022 | 61.6 | 4.48 | 0.034 | 62.0 | 86.1 | 95.9 |
| Test | 44.6 | 0.032 | 62.3 | 4.67 | 0.037 | 62.3 | 87.0 | 72.0 |
| Control | 44.7 | 0.032 | 62.0 | 4.63 | 0.038 | 61.4 | 85.1 | 72.9 |
| Test | 42.5 | 0.034 | 61.6 | 4.53 | 0.036 | 57.2 | 82.9 | 60.5 |
| Control | 42.6 | 0.029 | 61.5 | 4.26 | 0.042 | 54.0 | 78.0 | 78.2 |
| Test | 43.2 | 0.024 | 62.0 | 4.60 | 0.038 | 58.3 | 83.7 | 92.3 |
| Control | 43.1 | 0.025 | 61.8 | 4.23 | 0.041 | 56.9 | 81.6 | 93.3 |
| Test | 44.2 | 0.029 | 62.4 | 4.47 | 0.032 | 61.6 | 87.0 | 68.0 |
| Control | 44.1 | 0.025 | 62.7 | 3.87 | 0.041 | 56.2 | 80.0 | 92.2 |

As can be seen from the above data, the phosphorous content of the resulting product was lowered to within acceptable standards while the silica levels were kept within acceptable levels.

The results found in Example 2 show some improvement in phosphorous content, however, not as extensive an improvement as found in the tests of Example 1. This is due to the ore having lower concentrations of phosphorous prior to the flotation process. When ore having lower phosphorous content is used, it is expected that the phosphorous capable of being removed is limited. There is some phosphorous that can never be removed if iron recovery is to be kept at optimum levels. (High phosphorous containing ore has approximately 0.042% phosphorous in the float feed.) It should be understood that any lowering of phosphorous content while maintaining acceptable iron recovery is greatly desired.

While the principles of this invention have been described in connection with specific embodiments, it should be understood clearly that these descriptions are made only by way of example and are not intended to limit the scope of the invention.

What is claimed:

1. A by-product resulting from purifying iron ore by subjecting an apatite containing iron ore to froth flotation, said by-product comprising:

an ore impurity containing apatite; and an apatite flotation reagent comprising a lecithin adhering to the impurity, the lecithin selected from the group consisting of animal lecithin and vegetable lecithin, having the general structural formula:

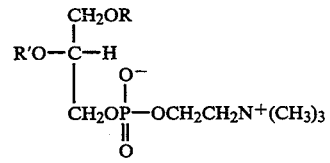

wherein R and R′ are longer chain fatty groups containing approximately 8–20 carbon atoms.

2. A by-product as in claim 1 wherein the lecithin is a vegetable lecithin.

3. A by-product as in claim 2 wherein the vegetable lecithin is derived from vegetable oils selected from the group consisting of soybean oil, corn oil, rapeseed oil, peanut oil, sunflower oil or safflower oil.

4. A by-product as in claim 3 wherein the vegetable lecithin is derived from soybean oil.

5. A by-product as in claim 2 wherein the vegetable lecithin is soya lecithin.

6. A by-product as in claim 1 wherein the apatite flotation reagent further includes a phosphate ester.

7. A by-product as in claim 6 wherein the lecithin comprises 0.1–99.9 weight percent of the reagent and the phosphate ester comprises 99.9–0.1 weight percent of the reagent.

8. A by-product as in claim 7 wherein lecithin comprises 50.0–85.0 weight percent of the reagent and phosphate ester comprises 15.0–50.0 weight percent of the reagent.

9. A by-product as in claim 8 wherein lecithin comprises 50.0 weight percent of the reagent and phosphate ester comprises 50.0 weight percent of the reagent.

10. A by-product as in claim 6 wherein the phosphate ester is an ethylene oxide modified alcohol based phosphate ester.

11. A by-product as in claim 10 wherein the alkyl group of the phosphate ester includes six to twenty-six carbon atoms.

12. A by-product as in claim 11 wherein the alkyl groups of the phosphate ester are highly branched.

13. A by-product as in claim 10 wherein the phosphate ester is selected from the group consisting of: Bis-[tri-(2-hydroxyethyl)-[ isododecyl phosphate or Bis-[Nona-(2-hydroxyethyl)-] isododecyl phosphate.

14. An improved apatite flotation reagent comprising a mixture of lecithin and an ethylene oxide modified alcohol based phosphate ester with a weight % ratio of:

65 to 0.1 weight percent lecithin, and 35 to 99.9 weight percent phosphate ester.

15. An improved apatite flotation reagent as in claim 14 wherein the lecithin is soya lecithin.

16. An improved apatite flotation reagent as in claim 14 wherein the alkyl group of the phosphate ester includes six to twenty-six carbon atoms.

17. An improved apatite flotation reagent as in claim 16 wherein the alkyl groups of the phosphate ester are highly branched.

18. An improved apatite flotation reagent as in claim 17 wherein the phosphate ester is selected from the group consisting of: Bis-[tri-(2-hydroxyethyl)-] isododecyl phosphate or Bis-[Nona-(2-hydroxyethyl)-] isododecyl phosphate.

* * * * *